United States Patent [19]

Sullivan

[11] Patent Number: 4,651,447

[45] Date of Patent: Mar. 24, 1987

[54] ENHANCING SHOE VISIBILITY IN DARKNESS

[76] Inventor: Edith Sullivan, 21 Osgood St., Methuen, Mass. 01844

[21] Appl. No.: 177,985

[22] Filed: Aug. 14, 1980

Related U.S. Application Data

[63] Continuation of Ser. No. 32,486, Apr. 23, 1979, abandoned.

[51] Int. Cl.[4] ..... A43B 23/00

[52] U.S. Cl. ..... 36/137; 36/50; 24/143 R; 350/638

[58] Field of Search ..... 36/50, 137; 24/143 R, 24/143 A, 143 B; 250/462; 350/98, 290, 298; 362/84, 103, 105, 108; 427/157, 158

[56] References Cited

U.S. PATENT DOCUMENTS

| | | | |
|---|---|---|---|
| 748,703 | 1/1904 | Congdon | 24/143 R |
| 3,947,928 | 4/1976 | Maldonado | 24/143 R |
| 4,188,737 | 2/1980 | Haver | 36/137 |

*Primary Examiner*—Werner H. Schroeder
*Attorney, Agent, or Firm*—Charles Hieken

[57] ABSTRACT

A jogging shoe includes a shoelace of folded-over retro-flective fabric or tape terminated at each end with a firm tip of diameter less than that of the lace openings in the shoe.

16 Claims, 6 Drawing Figures

ENHANCING SHOE VISIBILITY IN DARKNESS

This application is a continuation of application Ser. No. 032,486, filed on Apr. 23, 1979, now abandoned.

The present invention relates in general to improving the safety of runners and walkers and more particularly concerns novel apparatus and techniques for enhancing the safety of those who jog or walk at night while facing oncoming vehicular traffic in a manner that effects a significant increase in safety at slight cost and without inconveniencing the jogger. The invention may be readily adapted to existing shoes.

Jogging is recognized as a source of healthful exercise. Many joggers who work during the day prefer to jog at night. A frequent path for night joggers is the edge of a road carrying vehicular traffic. It has long been recognized for safety reasons that a pedestrian should face oncoming traffic. Still a person jogging at night is difficult to see, and it has been suggested to enhance visibility by using reflective material on the jogger's shoes. However, various attempts to put reflective material on the shoe sole or upper have not been regarded as effective. It is important that the reflective material provide significant enhancement when a vehicle driver approaches an oncoming jogger at the side of the road.

U.S. Pat. No. 2,233,544 discloses a reflector attachment for shoes comprising a harness having a front elastic band that supports a front reflector over the shoelace and a rear elastic band that supports a rear reflector behind the heal with an inelastic band joining the elastic bands for seating under the instep to help keep the harness in position. A disadvantage with this arrangement is that it requires extra components being added to the jogging shoe that may be disconcerting to the jogger and make jogging uncomfortable.

It is also known to wear a reflective band or bands across the torso, such as disclosed in U.S. Pat. No. 3,499,416. While reflective material on the torso does enhance visibility, the relatively little movement of the torso does not provide nearly as noticeable an indication of a jogger as reflective material on the rapidly moving feet of the jogger. Flashing light sources have long been recognized as more attention-getting than nonflashing sources.

Other examples of the prior art uncovered during the course of a search in subclass 143 of class 24, subclass 462 of class 250, subclasses 290 and 298 of class 350, subclasses 84, 103, 105 and 108 of class 362 and subclasses 157 and 158 of class 427 include the following other U.S. Pat. Nos.: 2,681,449, 2,341,583, 291,033, 2,473,877, 2,333,641, 2,342,005, 2,607,130 and 4,022,709.

It is an important object of this invention to provide improved visibility for joggers and walkers facing oncoming traffic at night.

It is another object of the invention to achieve the preceding object with a relatively inexpensive modification to a component of existing shoes so that the jogger or walker may continue to jog or walk without distraction.

It is a further object of the invention to achieve one or more of the preceding objects with no additional power from the runner or walker and negligible additional weight.

It is a further object of the invention to achieve one or more of the preceding objects with structure that may be economically and conveniently used to retrofit existing shoes.

According to the invention, a running or jogging shoe has a shoelace of reflective material. According to a specific form of the invention, an exemplary lace comprises commercially available 3M retroreflective fabric or tape formed with a longitudinal fold with the adhesive faces of the fabric or tape facing each other on the inside and adhered together with the tips wrapped with masking tape to form a firm tip of diameter less than the diameter of the lace openings in the shoe to facilitate lacing the reflective lace thus formed in the shoe.

Numerous other features, objects and advantages of the invention will become apparent from the following specification when read in connection with the accompanying drawing in which:

FIG. 3 shows a portion of lace stitched along two edges;

FIG. 4 is a view of a preferred form of the invention having a reinforcing core of cotton tape or other suitable material inside the folded-over fabric or tape between the two rows of stitches; and FIGS. 5 and 6 are magnified views of exposed lens and enclosed lens retroreflective material, respectively.

Figure 1:
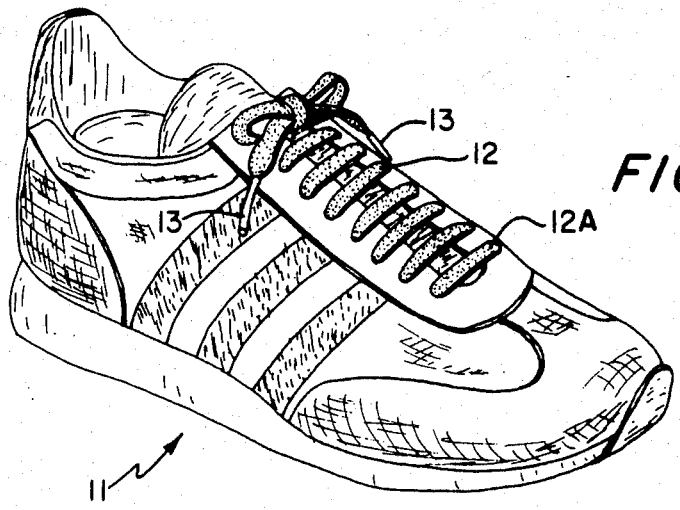
FIG. 1 is a perspective view of a jogging shoe having a reflective lace according to the invention.

With reference now to the drawing, and more particularly FIG. 1 thereof, there is shown a perspective view of a conventional jogging shoe 11 having a lace 12 of reflective material therein threaded through lace openings in the top of the shoe upper behind the tip.

Figure 2:
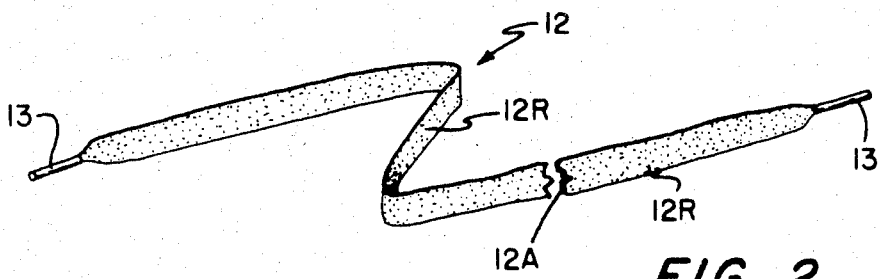
FIG. 2 is a perspective view of a lace formed of reflective fabric or tape according to the invention.

Referring to FIG. 2, there is shown lace 12 to illustrate its construction in an exemplary form. Lace 12 may comprise reflective fabric or tape such as commercially available 3M SCOTCHLITE reflective trim that typically is obtainable in ¾-inch widths having a reflective surface 12R on one side, and an adhesive 12A may be applied on the other side. The fabric or tape may be cut to the length of a typical shoelace, such as 26 inches, this length folded along its longitudinal axis with reflective surfaces 12R outside and adhesive surfaces 12A facing each other, and the two halves pressed together so that the adhesive surfaces adhere to one another to form lace 12. Alternatively, adhesive 12A may be omitted and the two halves stitched together at least along the longitudinal edge opposite the fold, but preferably double-stitched along both longitudinal edges with a double needle for greater strength and more pleasing appearance as shown in FIG. 3. The ends 13 may then be wrapped with material, such as masking tape, or other suitable material, to form firm tips of diameter less than that of the diameter of the lace openings in the shoe.

Referring to FIG. 4, there is shown a perspective view of a portion of a preferred lace according to the invention with a portion of the stitches removed to expose the reinforcing strip of cotton or other suitable material 21 located inside the folded-over retroreflective material between the rows of stitches 22 and 23. Preferably the reinforcing member is cotton tape that is strong and flexible.

The reflective material is preferably enclosed lens or exposed lens material as shown in the magnified views of FIGS. 5 and 6, respectively, that produces retroreflection; that is, the reflective material returns a significant amount of the incoming light directly back to the source of the light whereby the retroreflective material appears brightest to an observer located near the light source. Thus, a driver in an automobile facing an oncoming jogger along the right side of the road looking over his right headlight sees the bright moving pattern of the moving shoelaces as the jogger runs toward him, thereby enabling the driver to remain clear of the jogger. FIG. 5 is a magnified sectional view through a portion of enclosed lens material having a protective liner 31, precoated adhesive 32, metallic reflector coat 33 and glass beads such as 34 enclosed in durable transparent plastic 35. FIG. 6 shows a sectional view of exposed lens reflective fabric having a flexible cloth backing 36, a plastic resin 37 and partially exposed glass beads such as 38, partially embedded in the plastic resin.

The invention has a number of advantages. Enhanced visibility is provided at relatively low cost and negligible inconvenience to the jogger. There is no harness assembly to be slipped over the shoe that might jiggle while running or otherwise distract the runner, add undesired weight to the shoe, perhaps interfering with the desirable running characteristics of the shoe, or add other problems. The invention may be readily and inexpensively fitted to existing running and walking shoes. Furthermore, the sturdy material functions as a lace having a relatively long life while adequately helping to secure the shoe to the foot of the wearer.

It is evident that those skilled in the art may now make numerous uses and modifications of and departures from the specific apparatus and techniques described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. A shoe having a lace of retroreflective material threaded through lace openings in the shoe upper, wherein said retroreflective material is lens material, and wherein said material comprises a strip that is retroreflective on one surface and adhesive on the other folded along its length with the retroreflective surface remaining exposed and the adhesive surface being concealed with opposed portions thereof in adhesive engagement.

2. A shoe in accordance with claim 1 and further comprising, means at the tip of said lace forming a firm tip of diameter less than that of the lace openings in said shoe for guiding said lace through said openings when inserting said lace through said openings.

3. A shoe having a lace of retroreflective material threaded through lace openings in the shoe upper, wherein said retroreflective material is lens material, and wherein said material comprises a strip that is retroreflective on one surface folded along its length into two opposed portions with the retroreflective surface remaining exposed and said portions stitched together along at least the longitudinal edges opposite the fold.

4. A shoe in accordance with claim 3 wherein said portions are stitched together along both longitudinal edges.

5. A lace of lens reflective material comprising a strip that is retroreflective on one surface folded along its length into two opposed portions with the retroreflective surface remaining exposed, means at each end forming a firm tip of diameter less than the lace width, and means for fastening the portions together.

6. A lace in accordance with claim 5 wherein said means for fastening comprises adhesive material on the facing surfaces of opposed portions.

7. A lace in accordance with claim 5 wherein said means for fastening comprises stitches along at least the longitudinal edges opposite the fold.

8. A lace in accordance with claim 5 wherein said means for fastening comprises stitches along both longitudinal edges.

9. A lace in accordance with claim 5 and further comprising, a reinforcing strip between said two opposed portions.

10. A shoe having a lace of retroreflective material threaded through lace openings in the shoe upper, wherein said material comprises a strip of retroreflective material folded along its length with the retroreflective surface remaining exposed, a reinforcing strip inside said folded-over strip, and means for fastening the folded-over portions together with the reinforcing strip inside.

11. A shoe in accordance with claim 10 wherein said means for fastening comprises stitching along at least the longitudinal edges opposite the fold.

12. A shoe in accordance with claim 11 wherein said portions are stitched together along both longitudinal edges with said reinforcing strip between the stitched edges.

13. A shoe in accordance with claim 12 wherein said reinforcing strip is cotton tape.

14. A lace in accordance with claim 9 wherein said means for fastening comprises stitching along at least the longitudinal edges opposite the fold.

15. A lace in accordance with claim 14 wherein said portions are stitched together along both longitudinal edges with said reinforcing strip between the stitched edges.

16. A lace in accordance with claim 15 wherein said reinforcing strip is cotton tape.

* * * * *